US007844058B2

(12) United States Patent
Tohyama et al.

(10) Patent No.: US 7,844,058 B2
(45) Date of Patent: Nov. 30, 2010

(54) HEARING PROCESSING METHOD AND HEARING AID USING THE SAME

(75) Inventors: Mikio Tohyama, Tokyo (JP); Michiko Kazama, Tokyo (JP); Yoshinori Takahashi, Tokyo (JP); Kiyoaki Terada, Tokyo (JP); Shinichi Sakamoto, Tokyo (JP); Keisuke Watanuki, Tokyo (JP); Takeshi Nakaichi, Tokyo (JP)

(73) Assignees: Rion Co., Ltd., Tokyo (JP); Waseda University, Tokyo (JP)

( * ) Notice: Subject to any disclaimer, the term of this patent is extended or adjusted under 35 U.S.C. 154(b) by 1287 days.

(21) Appl. No.: 11/388,244

(22) Filed: Mar. 23, 2006

(65) Prior Publication Data

US 2006/0222193 A1 Oct. 5, 2006

(30) Foreign Application Priority Data

Mar. 23, 2005 (JP) ..... 2005-083243
Mar. 23, 2005 (JP) ..... 2005-083402

(51) Int. Cl.
*H04R 25/00* (2006.01)

(52) U.S. Cl. ..... 381/60; 381/312; 381/316; 381/320

(58) Field of Classification Search ..... 381/60, 381/312, 316, 320
See application file for complete search history.

(56) References Cited

U.S. PATENT DOCUMENTS

2005/0141737 A1* 6/2005 Hansen ..... 381/316
2005/0185798 A1* 8/2005 Camey ..... 381/312

FOREIGN PATENT DOCUMENTS

JP 2001-095785 4/2001

* cited by examiner

*Primary Examiner*—Brian Ensey
(74) *Attorney, Agent, or Firm*—Carrier, Blackman & Associates P.C.; William D. Blackman; Joseph P. Carrier

(57) ABSTRACT

A hearing aid device for processing an input sound signal via a microphone so as to output a sound signal from an earphone comprises a signal processing element, a couple of acoustic nerve excitation pattern calculation elements, a couple of acoustic filter shape memory elements, a comparison element, a correction processing element, etc. The couple of acoustic nerve excitation pattern calculation elements calculate acoustic nerve excitation patterns of a normal hearing person and a hearing impaired person based on an output signal of the signal processing element and acoustic filter shapes of the normal hearing person and the hearing impaired person which are stored in the couple of acoustic filter shape memory elements. Each of the acoustic nerve excitation patterns is compared via the comparison element. Then, the correction processing element corrects the input sound signal such that the acoustic nerve excitation pattern of the hearing impaired person is identical with the acoustic nerve excitation pattern of the normal hearing person, so as to generate an output sound signal.

20 Claims, 10 Drawing Sheets

HEARING PROCESSING METHOD AND HEARING AID USING THE SAME

CROSS-REFERENCE TO RELATED APPLICATIONS

The present application claims priority under 35 USC 119 from Japanese Patent Applications 2005-083243 and 2005-083402, both filed 23 Mar. 2005. The entire contents of these two priority Japanese Applications are incorporated herein by reference. Also, the present application is based on Japanese Patent Application 2004-105909, filed 31 Mar. 2004, although no priority is claimed therefrom.

TECHNICAL FIELD

The present invention relates to a hearing aid processing method for adjusting a hearing aid based on degradation of frequency selective and to a hearing aid device employing the method.

RELATED ART

Almost all of currently popularized hearing aid devices have several kinds of adjustment functions. These adjustment functions include, for example, sub-volume, output limitation, tone control (a frequency characteristic adjustment mainly using a filter), automatic gain control (AGC) and the like. The degree of adjustment with respect to each adjustment function is freely changeable by a user or an adjuster such as a doctor, a salesperson, etc. The adjustment for each function is carried out on the basis of an adjustment value which is obtained by substituting an audiogram (a rise in the threshold of audibility) of a wearer of the hearing aid device in a prescribed formula.

Also, as a factor of the hearing aid there is considered the degradation of frequency selective or the like as well as a shape of the audiogram. When the audiogram is almost the same shape while the frequency selective is different in the degree of the degradation, even if the hearing aid device is adjusted based on the shape of the audiogram, there are some cases where a sentence intelligibility is not improved. Similarly, in the case of hearing impaired individuals who use the similar types of hearing aid devices, if the frequency selective is different in the degree of the degradation, the sentence intelligibility under noisy environments may not be improved in some cases.

In relation to the degree of the degradation of the frequency selective, the degrees of each hearing impaired individual are possible to be seen through the shape of an acoustic filter. It is known that the acoustic filter shapes of the sound-sensitive hearing impaired individuals differ in various ways dependent on frequency levels and sound pressure levels while the personal errors between the acoustic filter shapes are small with respect to normal hearing individuals.

In this connection, as a method of measuring the acoustic filter shape in a short time, there is known a frequency resolution measuring apparatus and the like (for example, see a patent reference 1).

Further, in addition to the acoustic filter shape, it is possible to know the degree of the degradation of the frequency selective by using a width of a critical threshold band, a masking pattern, or the like.

Patent Reference 1

Japanese patent application publication 2001-95785

As mentioned hereinabove, the degree of the degradation of the frequency selective can be measured via the acoustic filter shape and others. However, it is not possible to compensate the degradation of the frequency selective by the functions of the modern hearing aid devices.

Therefore, the hearing aid device capable of adjusting the hearing aid based on the degradation of the frequency selective will be desired to be developed.

The present invention is made in view of such disadvantages as seen in the prior art and has its object to provide a hearing aid processing method capable of adjusting the hearing aid based on the degradation of the frequency selective of the hearing aid device wearer (the hearing impaired individual) and to provide the hearing aid device implementing the method.

SUMMARY OF THE INVENTION

To achieve the above described object, according to a first aspect of the present invention, there is provided a hearing aid processing method for a hearing aid processing a sound signal inputted via a microphone so as to output a hearing aid processed sound signal from an earphone, comprising the step of obtaining an output sound signal by processing correction to an input sound signal such that an acoustic nerve excitation pattern of a hearing impaired individual is identical with an acoustic nerve excitation pattern of a normal hearing individual.

According to a second aspect of the invention, there is provided a hearing aid processing method for a hearing aid processing a sound signal inputted via a microphone so as to output a hearing aid processed sound signal from an earphone, comprising the steps of calculating an acoustic nerve excitation pattern of a hearing impaired individual, and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein when the correction coefficient becomes negative, a phase of the frequency component of the power spectrum is inverted, and the phase inverted frequency component of the power spectrum is multiplied by an absolute value of the correction coefficient.

According to a third aspect of the invention, there is provided a hearing-aid processing method for a hearing aid processing a sound signal inputted via a microphone so as to output a hearing aid processed sound signal from an earphone, comprising the steps of calculating an acoustic nerve excitation pattern of a hearing impaired individual, and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein the power spectrum is divided into two or more bands, and the correction coefficient is calculated with respect to each of frequency components of the respective bands.

According to a fourth aspect of the invention, there is provided a hearing-aid processing method for a hearing aid processing a sound signal inputted via a microphone so as to output a hearing aid processed sound signal from an earphone, comprising the steps of calculating an acoustic nerve excitation pattern of a hearing impaired individual, and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein a specific frequency component is extracted from the power spectrum and divided into two or more bands, and the correction coefficient is calculated with respect to each of frequency components of the respective bands.

According to a fifth aspect of the invention, there is provided a hearing aid processing method according to the first aspect, wherein the acoustic nerve excitation pattern is calculated from the input sound signal and a masking pattern.

According to a sixth aspect of the invention, there is provided a hearing aid processing method according to any of the first through fourth aspects, wherein the acoustic nerve excitation pattern is calculated from the input sound signal and an acoustic filter shape.

According to a seventh aspect of the invention, there is provided a hearing aid processing method according to any of the first through fourth aspects, wherein the acoustic nerve excitation pattern is calculated from the input sound signal and a width of a critical threshold band.

According to an eighth aspect of the invention, there is provided a hearing aid processing method according to any of the first through third and fifth through seventh aspects, wherein the acoustic nerve excitation pattern is calculated from a specific frequency component of the input sound signal.

According to a ninth aspect of the invention, there is provided a hearing aid device which processes a sound signal inputted via a microphone so as to output a hearing aid processed sound signal from an earphone, comprising a hearing aid processor which obtains an output sound signal by correcting an input sound signal such that an acoustic nerve excitation pattern of a hearing impaired individual is identical with an acoustic nerve excitation pattern of a normal hearing individual.

According to a tenth aspect of the invention, there is provided a hearing aid device according to the ninth aspect, wherein the hearing aid processor comprises a signal processing element for carrying out various processing with respect to an output signal of a microphone, an acoustic nerve excitation pattern calculation element for calculating each of acoustic nerve excitation patterns of a normal hearing individual and a hearing impaired individual from an output signal of the signal processing element and each of acoustic filter shapes of the normal hearing individual and the hearing impaired individual, an acoustic filter shape memory element for storing the acoustic filter shapes of the normal hearing individual and the hearing impaired individual, a comparison element for calculating a gain coefficient such that the acoustic nerve excitation pattern of the hearing impaired individual is identical with the acoustic nerve excitation pattern of the normal hearing individual, and a correction processing element for correcting the output signal of the signal processing element by the gain coefficient calculated by the comparison element.

According to an eleventh aspect of the invention, there is provided a hearing aid device according to the ninth aspect, wherein the hearing aid processor comprises a signal processing element for carrying out various processing with respect to an output signal of a microphone, an acoustic nerve excitation pattern calculation element for calculating each of acoustic nerve excitation patterns of a normal hearing individual and a hearing impaired individual from an output signal of the signal processing element and each of widths of critical threshold bands of the normal hearing individual and the hearing impaired individual, a critical threshold band width memory element for storing the widths of the critical threshold bands of the normal hearing individual and the hearing impaired individual, a comparison element for calculating a gain coefficient such that the acoustic nerve excitation pattern of the hearing impaired individual is identical with the acoustic nerve excitation pattern of the normal hearing individual, and a correction processing element for correcting the output signal of the signal processing element by the gain coefficient calculated by the comparison element.

According to a twelfth aspect of the invention, there is provided a hearing aid device according to the ninth aspect, wherein the hearing aid processor comprises a signal processing element for carrying out various processing with respect to an output signal of a microphone, an acoustic nerve excitation pattern calculation element for calculating each of acoustic nerve excitation patterns of a normal hearing individual and a hearing impaired individual from an output signal of the signal processing element and each of masking patterns of the normal hearing individual and the hearing impaired individual, a masking pattern memory element for storing the masking patterns of the normal hearing individual and the hearing impaired individual, a comparison element for calculating a gain coefficient such that the acoustic nerve excitation pattern of the hearing impaired individual is identical with the acoustic nerve excitation pattern of the normal hearing individual, and a correction processing element for correcting the output signal of the signal processing element by the gain coefficient calculated by the comparison element.

According to a thirteenth aspect of the invention, there is provided a hearing aid device which hearing aid processes a sound signal inputted via a microphone so as to output a hearing aid processed sound signal from an earphone, comprising a hearing aid processor which calculates an acoustic nerve excitation pattern of a hearing impaired individual and obtains an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein when the correction coefficient becomes negative, a phase of the frequency component of the power spectrum is inverted, and the phase-inverted frequency component of the power spectrum is multiplied by an absolute value of the correction coefficient.

According to a fourteenth aspect of the invention, there is provided a hearing aid device which hearing aid processes a sound signal inputted via a microphone so as to output a hearing aid processed sound signal from an earphone, comprising a hearing aid processor which calculates an acoustic nerve excitation pattern of a hearing impaired individual and obtains an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein the power spectrum is divided into two or more bands, and the correction coefficient is calculated with respect to each of the frequency components of the respective bands.

According to a fifteenth aspect of the invention, there is provided a hearing aid device which hearing aid processes a sound signal inputted via a microphone so as to output a hearing aid processed sound signal from an earphone, comprising a hearing aid processor which calculates an acoustic nerve excitation pattern of a hearing impaired individual and obtains an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein a specific frequency component is extracted from the power spectrum and divided into two or more bands, and the correction coefficient is calculated with respect to each of the frequency components of the respective bands.

According to a sixteenth aspect of the invention, there is provided a hearing aid device according to any of the ninth through fourteenth aspects, wherein the acoustic nerve excitation pattern is calculated from a specific frequency component of the input sound signal.

According to a seventeenth aspect of the invention, there is provided a hearing aid device according to any of the thirteenth through sixteenth aspects, wherein the acoustic nerve excitation pattern is calculated from the input sound signal and an acoustic filter shape.

According to an eighteenth aspect of the invention, there is provided a hearing aid device according to claim 13, 14, 15 or 16 any of the thirteenth through sixteenth aspects, wherein the acoustic nerve excitation pattern is calculated from the input sound signal and a width of a critical threshold band.

According to a nineteenth aspect of the invention, there is provided a hearing aid device according to any of the tenth through twelfth aspects, wherein the hearing aid device outputs an inspection sound for obtaining the acoustic filter shape, the width of the critical threshold band or the masking pattern.

According to a twentieth aspect of the invention, there is provided a hearing aid device according to the seventeenth or eighteenth aspect, wherein the hearing aid device outputs an inspection sound for obtaining the acoustic filter shape or the width of the critical threshold band.

EFFECTS OF THE INVENTION

According to the first aspect of the invention, the output sound signal is obtained by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound with a sense or feeling similar to the normal hearing individual.

According to the second aspect of the invention, the output sound signal is obtained by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound with a sense or feeling similar to the normal hearing individual.

According to the third aspect of the invention, the output sound signal is obtained by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual. Also, since the power spectrum is divided into two or more bands and the correction coefficient by which each frequency component of the power spectrum of the input sound signal is multiplied is calculated with respect to each of the frequency components of the respective bands, it is possible to obtain fine correction coefficients.

According to the fourth aspect of the invention, the output sound signal is obtained by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual. Further, since the specific frequency component is extracted from the power spectrum and divided into two or more bands and the correction coefficient by which each frequency component of the power spectrum of the input sound signal is multiplied is calculated with respect to each of the frequency components of the respective bands, it is possible to obtain fine correction coefficients.

According to the fifth aspect of the invention, the masking pattern which represents the degree of degradation of the frequency selective is used, when obtaining the output sound signal by correcting the input sound signal such that the acoustic nerve excitation pattern of the hearing impaired individual is identical with the acoustic nerve excitation pattern of the normal hearing individual. Therefore, the degradation of the frequency selective may be compensated so as to be capable of hearing the sound as sensitively as the normal hearing individual.

According to the sixth aspect of the invention, the acoustic filter shape which represents the degree of degradation of the frequency selective is used, when obtaining the output sound signal by correcting the input sound signal such that the acoustic nerve excitation pattern of the hearing impaired individual is identical with the acoustic nerve excitation pattern of the normal hearing individual. Therefore, the degradation of the frequency selective may be compensated so as to be capable of hearing the sound as sensitively as the normal hearing individual.

According to the seventh aspect of the invention, the width of the critical threshold band which represents the degree of degradation of the frequency selective is used, when obtaining the output sound signal by correcting the input sound signal such that the acoustic nerve excitation pattern of the hearing impaired individual is identical with the acoustic nerve excitation pattern of the normal hearing individual. Therefore, the degradation of the frequency selective may be compensated so as to be capable of hearing the sound as sensitively as the normal hearing individual.

According to the eighth aspect of the invention, since the acoustic nerve excitation pattern is calculated from the specific frequency component of the input sound signal, arithmetic operation processing may be accelerated.

Further, the specific frequency component of the input sound signal which represents the degree of degradation of the frequency selective is used, when obtaining the output sound signal by correcting the input sound signal such that the acoustic nerve excitation pattern of the hearing impaired individual is identical with the acoustic nerve excitation pattern of the normal hearing individual. Therefore, the degradation of the frequency selective may be compensated so as to be capable of hearing the sound as sensitively as the normal hearing individual.

According to the ninth aspect of the invention, the hearing aid processor performs hearing aid processing so as to obtain the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound with a sense or feeling similar to the normal hearing individual.

According to the tenth aspect of the invention, the hearing aid processor performs hearing aid processing with the acoustic filter shape which represents the degree of degradation of the frequency selective, so as to obtain the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound with a sense or feeling similar to the normal hearing individual.

According to the eleventh aspect of the invention, the hearing aid processor performs hearing aid processing with the width of the critical threshold band which represents the degree of degradation of the frequency selective, so as to obtain the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual.

According to the twelfth aspect of the invention, the hearing aid processor performs hearing aid processing with the masking pattern which represents the degree of degradation of the frequency selective, so as to obtain the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual.

According to the thirteenth aspect of the invention, the hearing aid processor performs hearing aid processing so as to obtain the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound with a sense or feeling similar to the normal hearing individual.

According to the fourteenth aspect of the invention, the hearing aid processor is provided for obtaining the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual. Also, since the power spectrum is divided into two or more bands and the correction coefficient by which each frequency component of the power spectrum of the input sound signal is multiplied is calculated with respect to each of the frequency components of the respective bands, it is possible to obtain fine correction coefficients.

According to the fifteenth aspect of the invention, the hearing aid processor is provided for obtaining the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual. Also, since the specific frequency component is extracted from the power spectrum and divided into two or more bands and the correction coefficient by which each frequency component of the power spectrum of the input sound signal is multiplied is calculated with respect to each of the frequency components of the respective bands, it is possible to obtain fine correction coefficients.

According to the sixteenth aspect of the invention, since the acoustic nerve excitation pattern is calculated from the specific frequency component of the input sound signal, arithmetic operation processing may be accelerated.

Further, the hearing aid processor uses the specific frequency component of the input sound signal which represents the degree of degradation of the frequency selective, for obtaining the output sound signal by correcting the input sound signal such that the acoustic nerve excitation pattern of the hearing impaired individual is identical with the acoustic nerve excitation pattern of the normal hearing individual. Therefore, the degradation of the frequency selective may be compensated so as to be capable of hearing the sound as sensitively as the normal hearing individual.

According to the seventeenth aspect of the invention, the hearing aid processor uses the acoustic filter shape which represents the degree of degradation of the frequency selective, for obtaining the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual.

According to the eighteenth aspect of the invention, the hearing aid processor uses the width of the critical threshold band which represents the degree of degradation of the frequency selective, for obtaining the output sound signal by correcting the input sound signal such that the acoustic nerve excitation pattern of the hearing impaired individual is identical with the acoustic nerve excitation pattern of the normal hearing individual, so that the degradation of the frequency selective may be compensated thereby being capable of hearing the sound as sensitively as the normal hearing individual.

According to the nineteenth aspect of the invention, the hearing aid device itself outputs the inspection sound for obtaining the acoustic filter shape, the width of the critical threshold band or the masking pattern. Therefore, when measuring the acoustic filter shape, the width of the critical threshold band or the masking pattern, it is not required to remove the hearing aid device whereby the usability of the hearing aid device can be improved.

According to the twentieth aspect of the invention, the hearing aid device itself outputs the inspection sound for obtaining the acoustic filter shape or the width of the critical threshold band. Therefore, when measuring the acoustic filter shape or the width of the critical threshold band, it is not required to remove the hearing aid device so as to improve the usability of the hearing aid device.

DETAILED DESCRIPTION OF PREFERRED EMBODIMENTS

Figure 2:
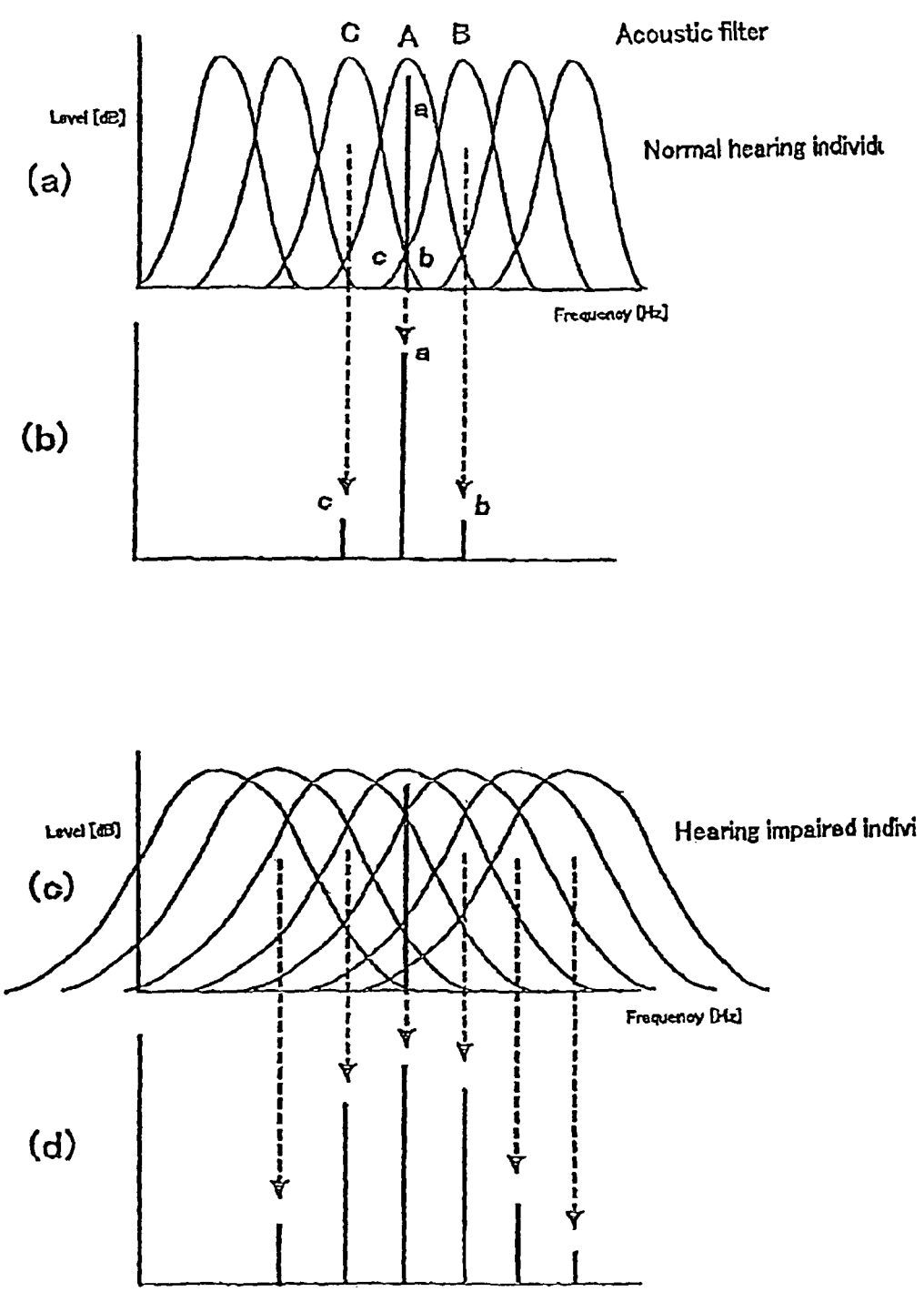
FIG. 2 is an explanatory view of a calculating method of an acoustic nerve excitation pattern from an acoustic filter shape, wherein (a) shows an input pure sound and an acoustic filter bank of the normal hearing individual, (b) shows an acoustic nerve excitation pattern of the normal hearing individual, (c) shows an input pure sound and an example of an acoustic filter bank of the hearing impaired individual, and (d) shows an example of an acoustic nerve excitation pattern of the hearing impaired individual.
Figure 3:
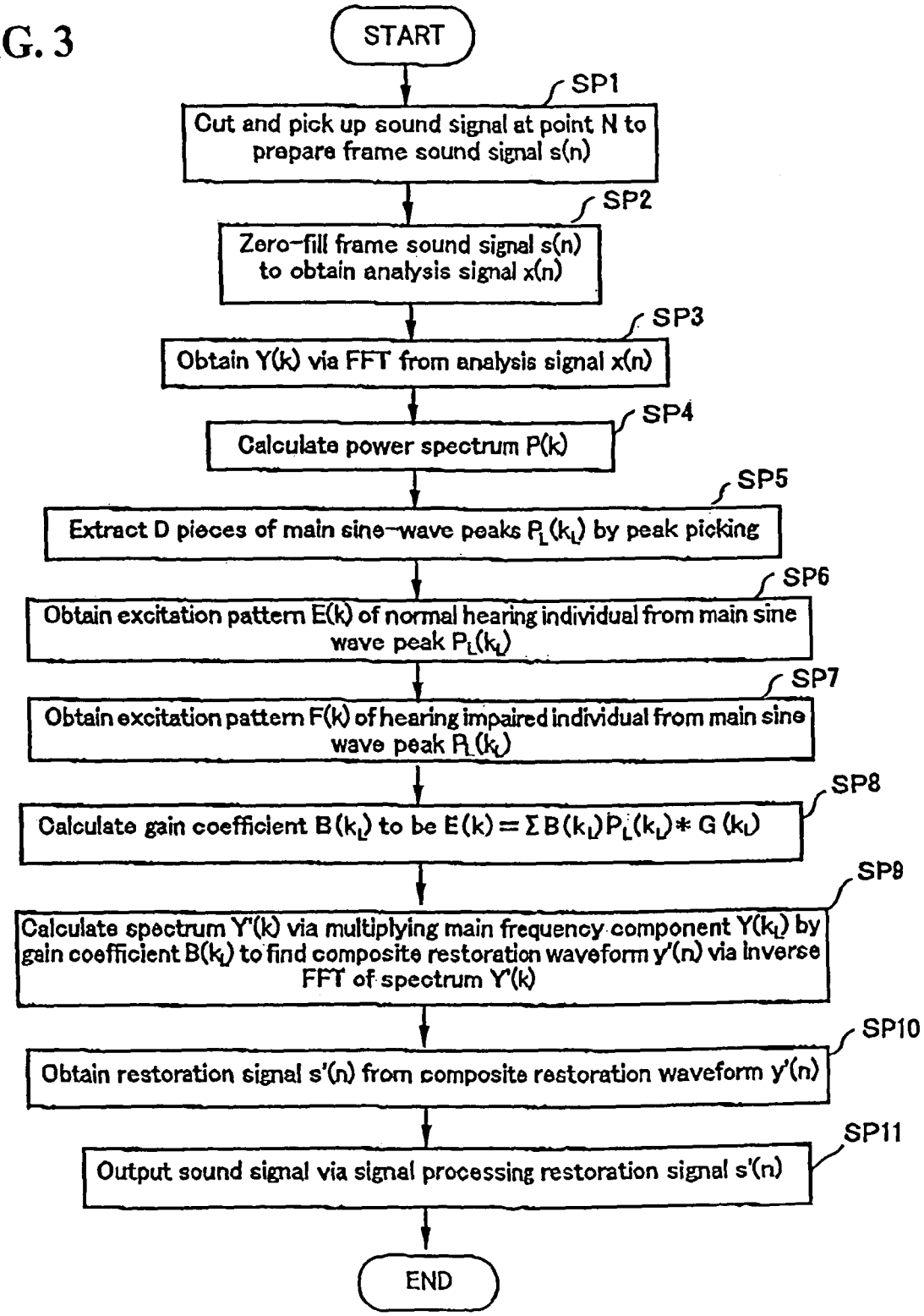
FIG. 3 is a flow chart of a correction processing process when using an acoustic filter shape in the first embodiment.
Figure 4:
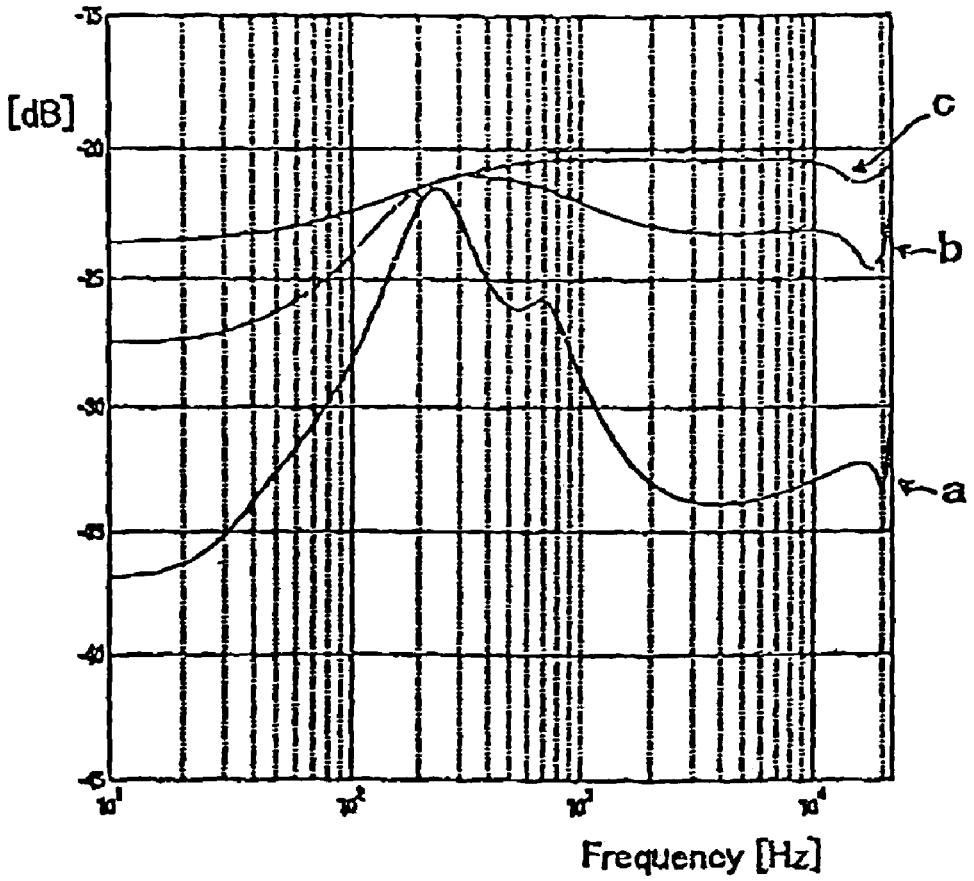
FIG. 4 is an example illustrating acoustic nerve excitation patterns in the first embodiment.
Figure 5:
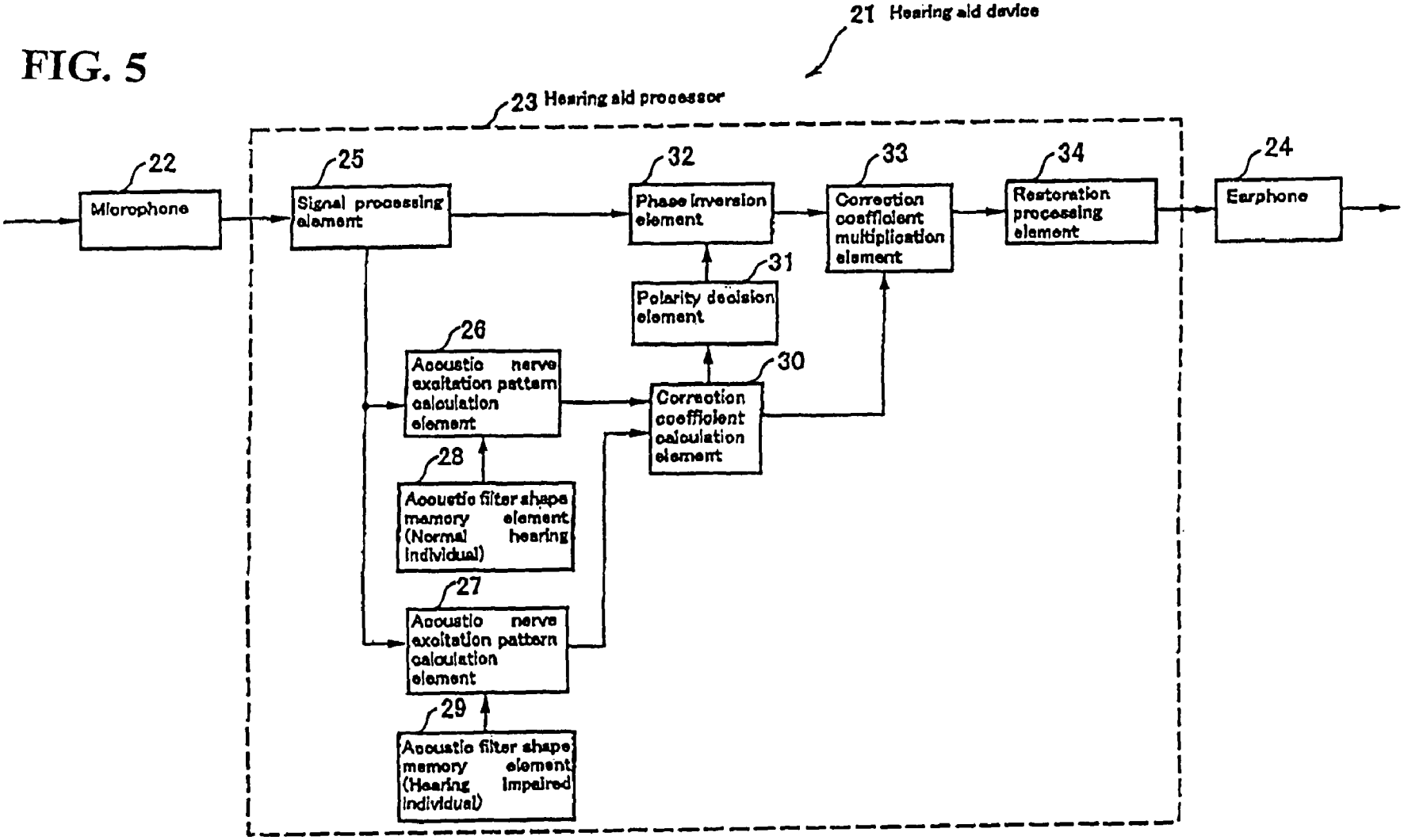
FIG. 5 is a schematic block diagram of a hearing aid device in relation to a second embodiment of the present invention.
Figure 6:
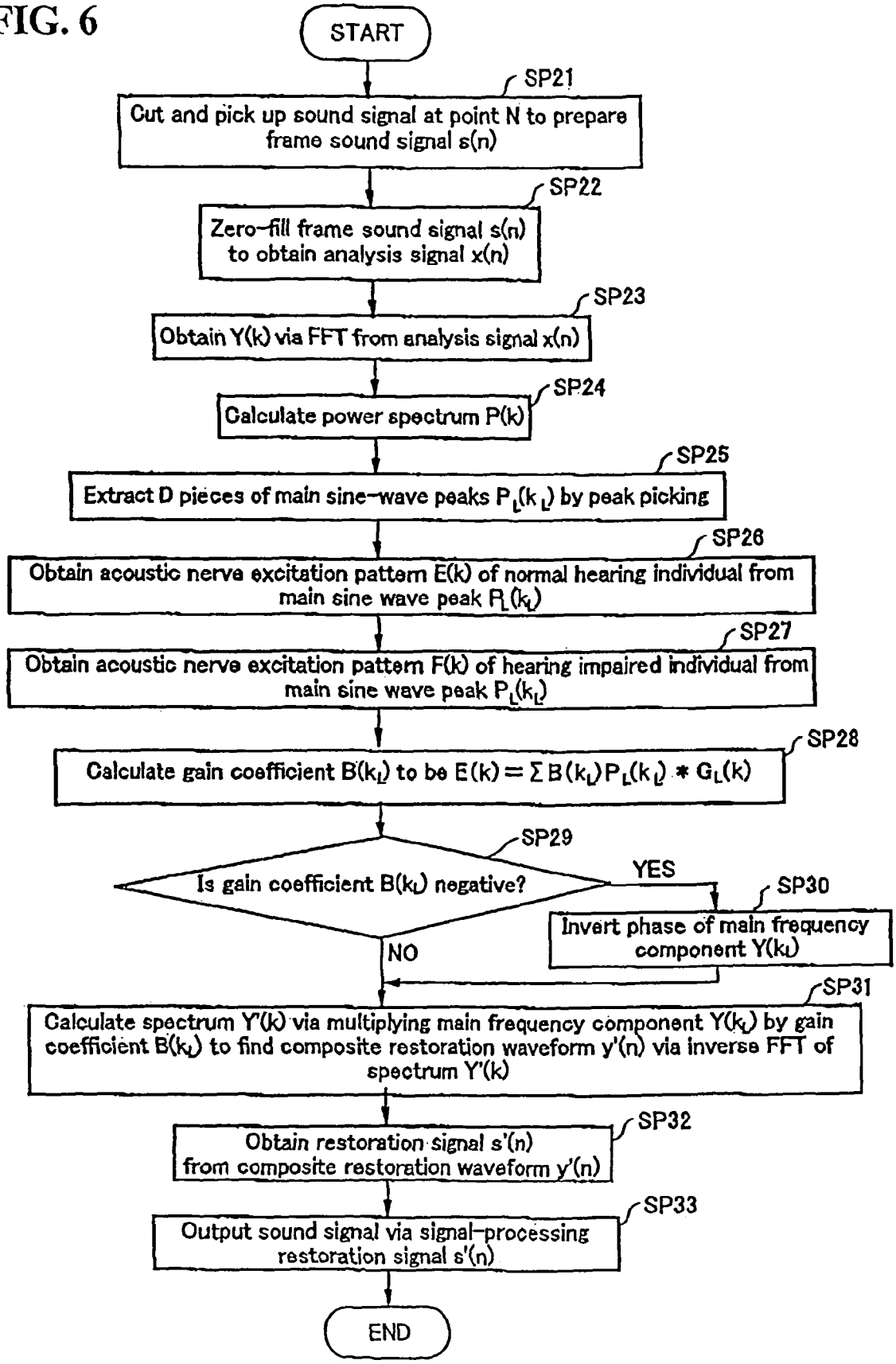
FIG. 6 is a flow chart of a correction processing process when using an acoustic filter shape in the second embodiment.
Figure 7:
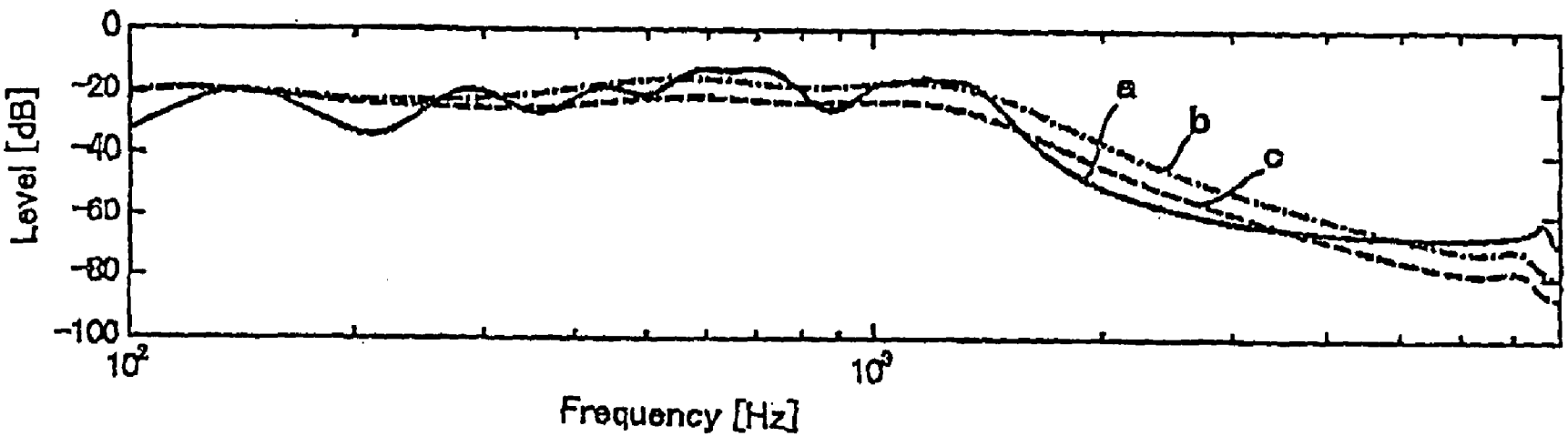
FIG. 7 is an example illustrating acoustic nerve excitation patterns in the second embodiment.
Figure 8:
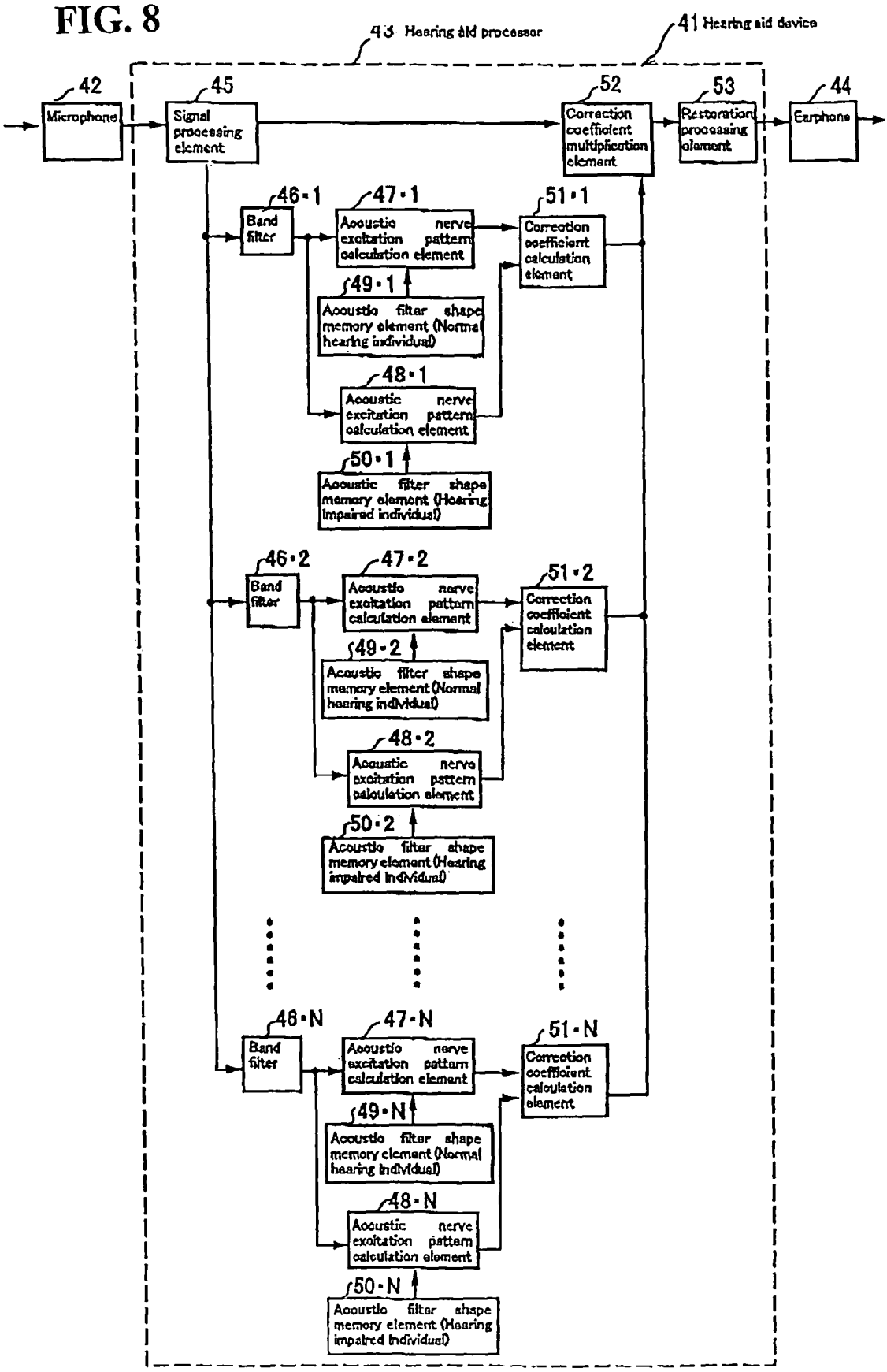
FIG. 8 is a schematic block diagram of a hearing aid device in relation to a third embodiment of the present invention.
Figure 9:
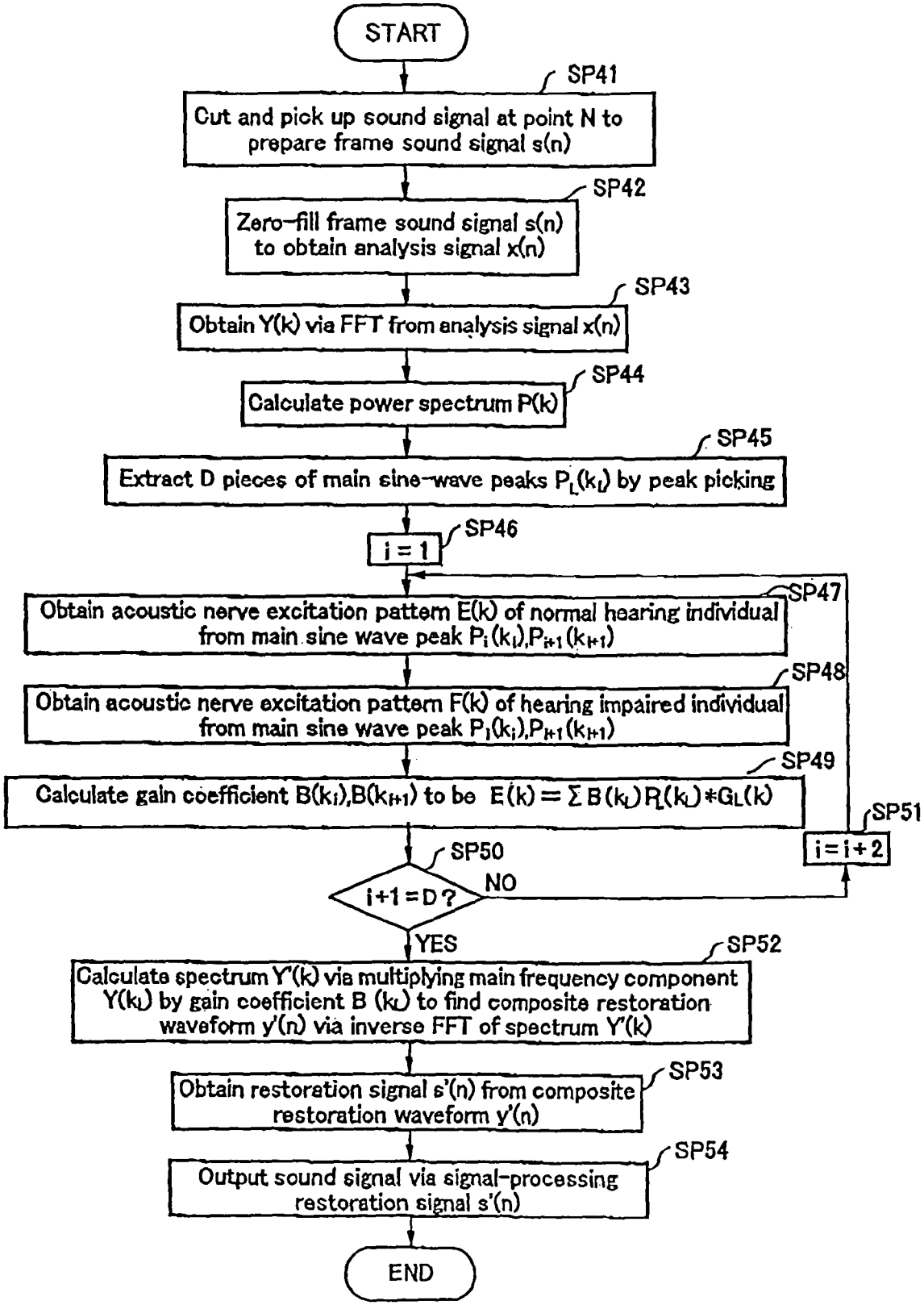
FIG. 9 is a flow chart of a correction processing process when using an acoustic filter shape in the third embodiment.
Figure 10:
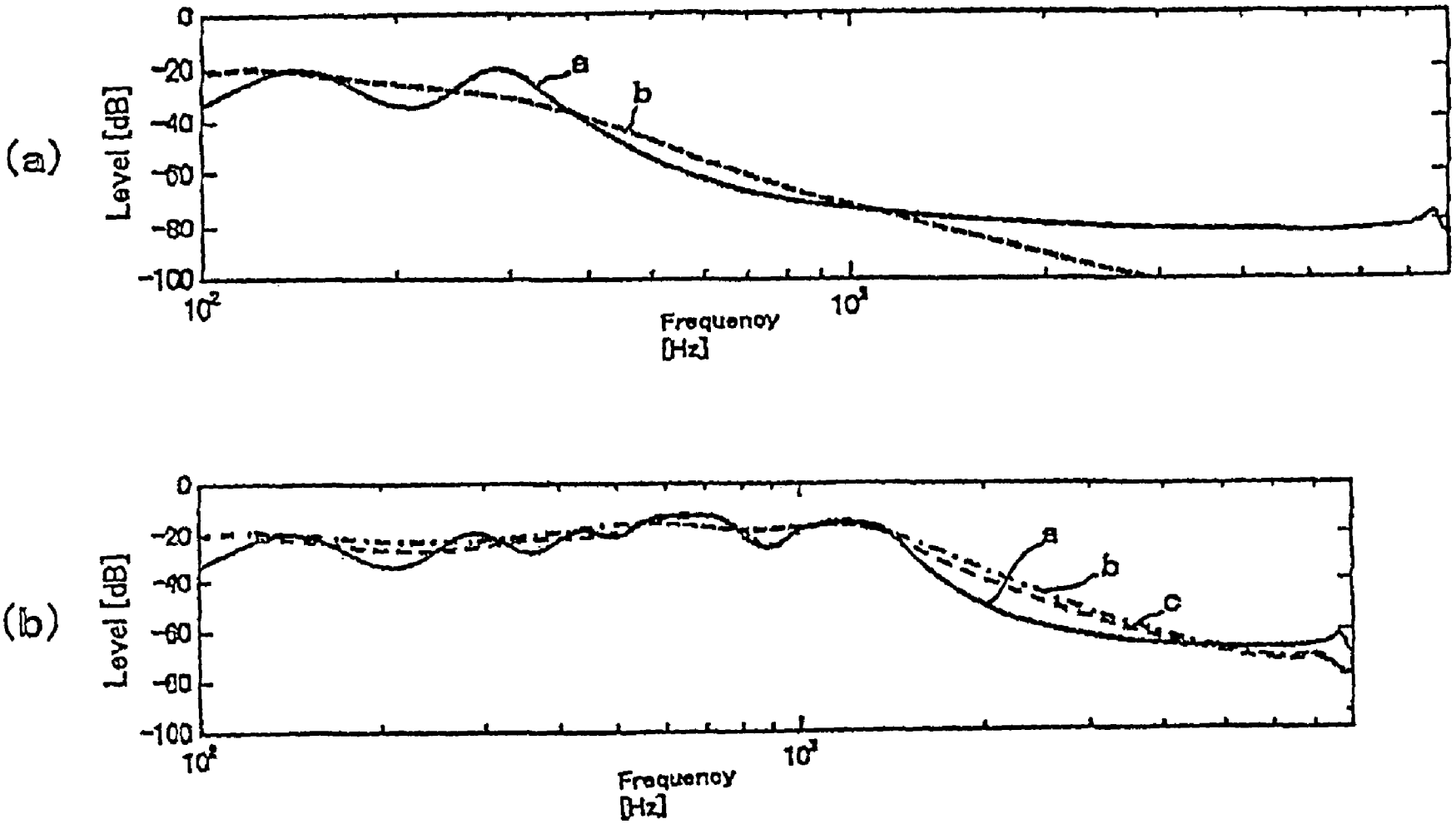
FIG. 10 is an example illustrating acoustic nerve excitation patterns in the third embodiment, wherein (a) shows acoustic nerve excitation patterns in one of divided bands, and (b) shows acoustic nerve excitation patterns after putting the divided bands together.

Hereinafter, the embodiments of the present invention will be explained with reference to the accompanying drawings. Herein, FIG. 1 is a schematic block diagram of a hearing aid device in relation to a first embodiment of the present invention, FIG. 2 is an explanatory view of a calculating method of an acoustic nerve excitation pattern from an acoustic filter shape, FIG. 3 is a flow chart of a correction processing process when using an acoustic filter shape in the first embodiment, FIG. 4 is an example illustrating acoustic nerve excitation patterns in the first embodiment, FIG. 5 is a schematic block diagram of a hearing aid device in relation to a second embodiment of the present invention, FIG. 6 is a flow chart of a correction processing process when using an acoustic filter shape in the second embodiment, FIG. 7 is an example illustrating acoustic nerve excitation patterns in the second embodiment, FIG. 8 is a schematic block diagram of a hearing aid device in relation to a third embodiment of the present invention, FIG. 9 is a flow chart of a correction processing process when using an acoustic filter shape in the third embodiment, and FIG. 10 is an example illustrating acoustic nerve excitation patterns in the third embodiment.

Figure 1:
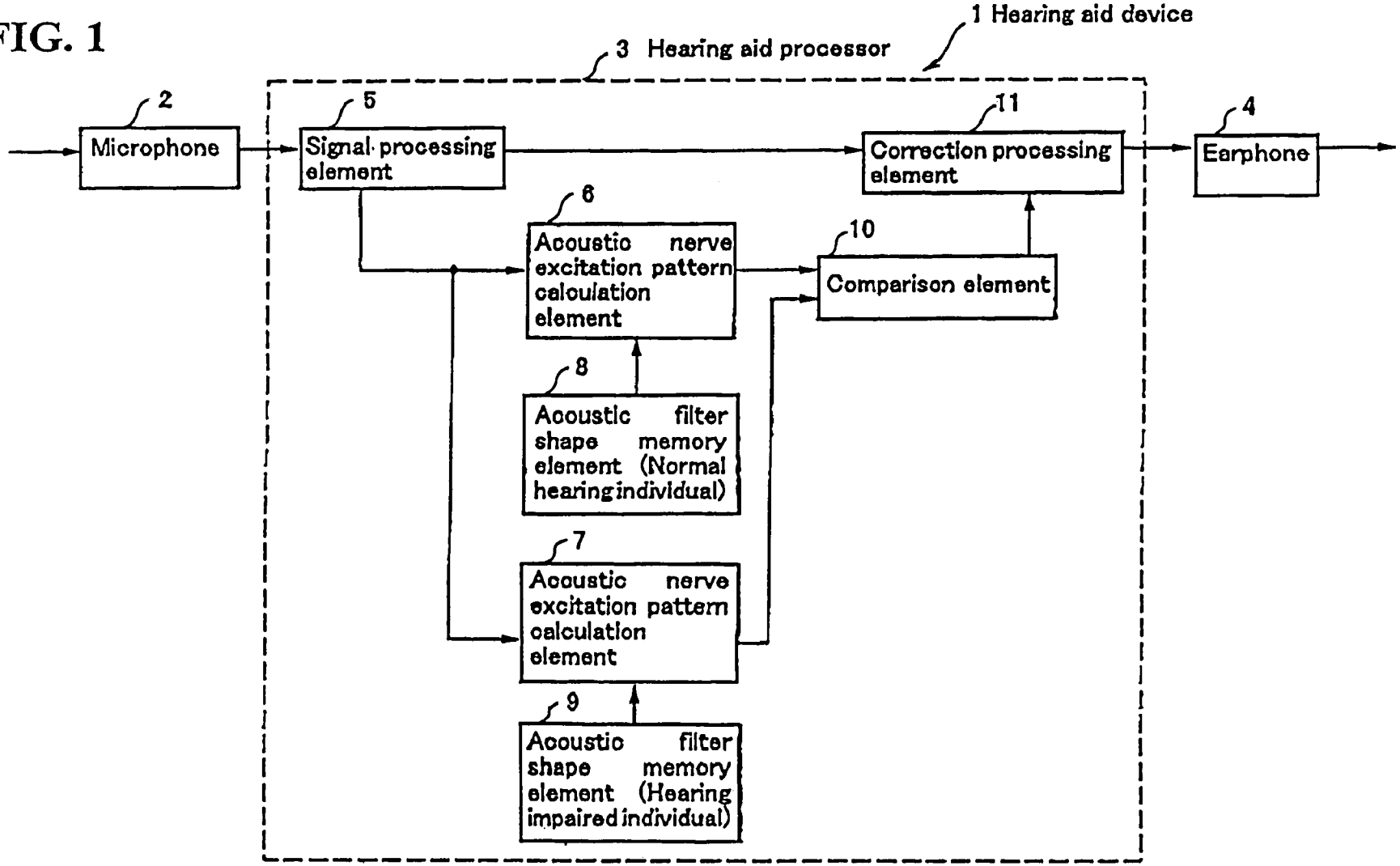
FIG. 1 is a schematic block diagram of a hearing aid device in relation to a first embodiment of the present invention.

As shown in FIG. 1, a hearing aid device 1 in relation to the first embodiment of the present invention comprises a microphone 2, a hearing aid processor 3 and an earphone 4. The hearing aid processor 3 is provided with a signal processing element 5, a couple of acoustic nerve excitation pattern calculation elements 6, 7, a couple of acoustic filter shape memory elements 8, 9, a comparison element 10, a correction processing element 11 and the like. Data of an acoustic filter shape of a normal hearing individual are stored in the acoustic filter shape memory element 8 in advance while data of an acoustic filter shape of a wearer (a hearing impaired individual) of a hearing aid device are measured in advance and stored in the acoustic filter shape memory element 9.

The microphone 2 converts a sound signal into an electric signal so as to output the converted electric signal. The hearing aid processor 3 performs various kinds of signal processing with respect to the electric signal outputted from the microphone 2 so as to output the hearing aid processed electric signal. The earphone 4 converts the output signal of the hearing aid processor 3 into an acoustic signal so as to output the same as a sound signal.

The signal processing element 5 calculates a power spectrum and performs peak picking and various kinds of signal processing with respect to the electric signal outputted from the microphone 2 so as to output a processed electric signal.

The acoustic nerve excitation pattern calculation element 6 calculates an acoustic nerve excitation pattern of the normal hearing individual from a power spectrum or a specific frequency component that is an output signal of the signal processing element 5 and from the acoustic filter shape of the normal hearing individual stored in the acoustic filter shape memory element 8. Another acoustic nerve excitation pattern calculation element 7 calculates an acoustic nerve excitation pattern from the power spectrum or the specific frequency component that is the output signal of the signal processing element 5 and from the acoustic filter shape stored in the acoustic filter shape memory element 9.

Herein, the acoustic nerve excitation pattern is the distribution of nerve activity excited by an oscillation of a basement membrane in a cochlea and represents an excitation amount caused by stimulation as a function of a frequency. FIG. 2 shows a calculation method of the acoustic nerve excitation pattern in the case of inputting a pure sound to an acoustic filter bank.

FIG. 2 (*a*) shows an input pure sound and an acoustic filter bank of the normal hearing individual. A passing amount of an acoustic filter "A" with respect to the input pure sound is "a", so that an output value "a" is obtained. Similarly, an output value "b" and an output value "c" are obtained from an acoustic filter "B" and an acoustic filter "C", respectively. These output values of the acoustic filters obtained in FIG. 2 (*a*) are plotted on FIG. 2 (*b*). This indicates the acoustic nerve excitation patterns. A research report in the past confirms that these acoustic nerve excitation patterns are in agreement with physiology data.

FIG. 2 (*c*) shows the input pure sound and an example of an acoustic filter bank of the hearing impaired individual. In the case of the hearing impaired individual, as seen from the acoustic filter shape, there are many cases where a band width of the acoustic filter is wider than the normal hearing individual. Then, when calculating the acoustic nerve excitation pattern, it is ascertained that it is different from that of the normal hearing individual, as seen in FIG. 2 (*d*).

The comparison element 10 compares the acoustic nerve excitation pattern of the normal hearing individual and the acoustic nerve excitation pattern of the hearing impaired individual so as to calculate such a gain coefficient that the acoustic nerve excitation pattern of the hearing impaired individual is identical with the acoustic nerve excitation pattern of the normal hearing individual.

The correction processing element 11, by using the gain coefficient, corrects the power spectrum that is the output signal of the signal processing element 5 corresponding to an input sound signal, so as to output a processed electric signal.

Next, the hearing aid processing method and an operation of the hearing aid device 1 employing the method in accordance with the present invention will be explained hereunder with reference to a flow chart as shown in FIG. 3.

At first, in step SP1, a sound signal is inputted from the microphone 2 and a frame sound signal s(n) is prepared by cutting and picking up a certain period of sound data at point "N". In step SP2, the sound signal s(n) is zero-filled to define here as point "M" so as to prepare an M-point analysis signal y(n). An analysis signal x(n) is prepared based on the M-point analysis signal y(n).

Next, in step SP3, Y(k) is obtained via FFT (fast Fourier transform) based on the M-point analysis signal x(n). In step SP4, a power spectrum P(k) of point M/2 is calculated.

Next, in step SP5, by performing peak picking, "D" pieces of main sine-wave peaks $P_L(k_L) \equiv |Y(k)|^2|_{K=KL} \equiv |Y(k_L)|^2$ (L=1, . . . D) are extracted from the power spectrum P(k). For example, given D=10, 10 pieces of the main sine-wave peaks $P_L(k_L)$ are extracted.

Then, in step SP6, the acoustic nerve excitation pattern E(k) of the normal hearing individual is found via frequency axis convolution operation of the power spectrum P(k) indicated by the following formula (1). Herein, $H_L(k)$ represents the acoustic filter of the normal hearing individual.

$$E(k) \equiv \sum P_L(k_L) * H_L(k) \tag{1}$$

Then, in step SP7, the acoustic nerve excitation pattern F(k) of the hearing impaired individual is found via frequency axis convolution operation of the power spectrum P(k) indicated by the following formula (2). Herein, $G_L(k)$ represents the acoustic filter of the hearing impaired individual.

$$F(k) \equiv \sum P_L(k_L) * G_L(k) \tag{2}$$

Next, in step SP8, there is calculated such a gain coefficient $B(k_L)$ as to be $E(k) \equiv \Sigma B(k_L) P_L(k_L) * G_L(k)$. Herein, the gain coefficient $B(k_L)$ with respect to "D" pieces of the main sine-wave peaks $P_L(k_L)$ is found as the least square error solution with respect to $$E(k) \equiv \sum B(k_L) P_L(k_L) * G_L(k).$$

In step SP9, a spectrum $Y'(k) \equiv (B(k_L))^{1/2} Y(k_L)$ that multiplies a main frequency component $Y(k_L)$ by the found gain coefficient $B(k_L)$ is calculated so as to find a composite restoration waveform y'(n) via M-point inverse FFT (fast Fourier transform) of the spectrum Y'(k).

In step SP10, after obtaining an analytic signal x'(n) by truncating the composite restoration waveform y'(n) at point "N", a restoration signal (frame sound signal) s'(n) is obtained via adoption of a real part (Re[x'(n)]) of the analytic signal x'(n).

Next, in step SP11, after fixing the wave-form by carrying out processing such as overlap processing, etc. with respect to the restoration signal s'(n), the processed restoration signal s'(n) is outputted as a sound signal from the earphone 4. Then, the sound signal outputted from the earphone 4 is such sound signal that the acoustic nerve excitation pattern is the same as the normal hearing individual, so that it is heard by the wearer (the hearing impaired individual) of the hearing aid device as such sound signal as the normal hearing individual feels.

FIG. 4 shows acoustic nerve excitation patterns "a", "b", "c" calculated by using the first embodiment of the present invention. "a" is calculated via the acoustic filter of the normal hearing individual. "b" and "c" are each calculated via the acoustic filters of the hearing impaired individuals on the assumption that band widths of the acoustic filters are three time and six times wider than that of the normal hearing individual.

Such gain coefficient $B(k_L)$ as these acoustic nerve excitation patterns of the hearing impaired individuals become identical with the acoustic nerve excitation pattern of the normal hearing individual is calculated in the step SP8, and then the composite restoration waveform y'(n) is found in the step SP9.

As shown in FIG. 5, a hearing aid device 21 in relation to a second embodiment of the present invention comprises a microphone 22, a hearing aid processor 23 and an earphone 24. The microphone 22 converts a sound signal into an electric signal so as to output the converted electric signal. The hearing aid processor 23 performs various kinds of signal processing with respect to the output electric signal of the microphone 22 so as to output the signal processed electric signal. The earphone 24 converts the output signal of the hearing aid processor 23 into an acoustic signal so as to output the same as a sound signal.

The hearing aid processor 23 comprises a signal processing element 25, a couple of acoustic nerve excitation pattern calculation elements 26, 27, a couple of acoustic filter shape memory elements 28, 29, a correction coefficient calculation element 30, a polarity decision element 31, a phase inversion element 32, a correction coefficient multiplication element 33, a restoration processing element 34, etc. Herein, data of an acoustic filter shape of a normal hearing individual are stored in the acoustic filter shape memory element 28 in advance while data of an acoustic filter shape of a wearer (a hearing impaired individual) of a hearing aid device are measured in advance and stored in the acoustic filter shape memory element 29.

The signal processing element 25 calculates a power spectrum by carrying out the fast Fourier transform (FFT) with respect to the electric signal outputted from the microphone 22 and outputs the power spectrum to each of the acoustic nerve excitation pattern calculation elements 26, 27 and to the phase inversion element 32. The signal processing element 25 also carries out peak picking and various kinds of signal processing.

The acoustic nerve excitation pattern calculation element 26 calculates an acoustic nerve excitation pattern of the normal hearing individual from a power spectrum or a specific frequency component that the signal processing element 25 outputs and from the acoustic filter shape of the normal hearing individual stored in the acoustic filter shape memory element 28. On the other hand, another acoustic nerve excitation pattern calculation element 27 calculates an acoustic nerve excitation pattern from the power spectrum or the specific frequency component that the signal processing element 25 outputs and from the acoustic filter shape stored in the acoustic filter shape memory element 29.

The correction coefficient calculation element 30 compares the acoustic nerve excitation pattern of the normal hearing individual that the acoustic nerve excitation pattern calculation element 26 calculates and the acoustic nerve excitation pattern of the hearing impaired individual that the acoustic nerve excitation pattern calculation element 27 calculates, so as to calculate such a gain coefficient that the acoustic nerve excitation pattern of the hearing impaired individual is identical with the acoustic nerve excitation pattern of the normal hearing individual, thereby inputting the same to the polarity decision element 31 and the correction coefficient multiplication element 33.

The polarity decision element 31 decides a polarity of the gain coefficient calculated by the correction coefficient calculation element 30 and, in the case where the gain coefficient is negative, inputs a decision signal to the phase inversion element 32.

When being inputted from the polarity decision element 31 such decision signal as the gain coefficient is negative, the phase inversion element 32 inverts a phase of a frequency component whose gain coefficient is decided negative with respect to the power spectrum outputted from the signal processing element 25, so as to input it to the correction coefficient multiplication element 33. When being not inputted from the polarity decision element such decision signal as the gain coefficient is negative, the power spectrum outputted from the signal processing element 25 is inputted as it is without inverting the phase thereof to the correction coefficient multiplication element 33.

The correction coefficient multiplication element 33 multiplies the frequency component of the power spectrum outputted from the phase inversion element 32 by the absolute value of the gain coefficient so as to input it to the restoration processing element 34.

The restoration processing element 34 obtains a restoration signal by carrying out inverse FFT (fast Fourier transform), etc. with respect to the power spectrum multiplied by the absolute value of the gain coefficient, so as to input the same to the earphone 24.

Next, the hearing aid processing method and an operation of the hearing aid device 21 employing the method in accordance with the present invention will be explained hereunder with reference to the flow chart as shown in FIG. 6.

Firstly, in step SP21, a sound signal is inputted via the microphone 22 and a frame sound signal s(n) is prepared by cutting and picking up a certain period of sound data at point "N". In step SP22, the sound signal s(n) is zero-filled to define here as point "M" so as to prepare an M-point analysis signal y(n). An analysis signal x(n) is prepared based on the M-point analysis signal y(n).

Thereafter, in step SP23, Y(k) is obtained via FFT (fast Fourier transform) based on the M-point analysis signal x(n). In step SP24, a power spectrum P(k) of point M/2 is calculated.

Next, in step SP25, by carrying out peak picking, "D" pieces of main sine-wave peaks $P_L(k_L) \equiv |Y(k)|^2|_{K=KL}|Y(k_L)|^2$ (L=1, . . . D) are extracted from the power spectrum P(k). For example, given D=10, 10 pieces of the main sine-wave peaks $P_L(k_L)$ are extracted.

Then, in step SP26, the acoustic nerve excitation pattern E(k) of the normal hearing individual is found via frequency axis convolution operation of the power spectrum P(k) indicated by the following formula (3).

Herein, $H_L(k)$ represents the acoustic filter of the normal hearing individual.

$$E(k) \equiv \sum P_L(k_L) * H_L(k) \tag{3}$$

Then, in step SP27, the acoustic nerve excitation pattern F(k) of the hearing impaired individual is found via frequency axis convolution operation of the power spectrum P(k) indicated by the following formula (4). Herein, $G_L(k)$ represents the acoustic filter of the hearing impaired individual.

$$F(k) \equiv \sum P_L(k_L) * G_L(k) \tag{4}$$

Next, in step S28, such gain coefficient $B(k_L)$ is found that the acoustic nerve excitation pattern, which is obtained by processing the frequency axis convolution operation with respect to the acoustic filter $G_L(k)$ of the hearing impaired individual after multiplying the main sine-wave peaks $P_L(k_L)$ by the gain coefficient $B(k_L)$, is equal to the acoustic nerve excitation pattern E(k) of the normal hearing individual. Namely, there is calculated such gain coefficient $B(k_L)$ as to be $E(k) \equiv \Sigma B(k_L)P_L(k_L)*G_L(k)$. Herein, the gain coefficient $B(k_L)$ with respect to "D" pieces of the main sine-wave peaks $P_L(k_L)$ is found as the least square error solution with respect to E(k)

$$\equiv \sum B(k_L)P_L(k_L) * G_L(k).$$

Next, in step SP29, there is decided whether the calculated gain coefficient $B(k_L)$ is negative or not. If the gain coefficient is decided to be negative, the phase of main frequency component $Y(K_L)$ is inverted in step SP30. Thereafter, in step SP31, a spectrum $Y'(k) \equiv (B(k_L))^{1/2}Y(k_L)$ that multiplies the phase-inverted main frequency component $Y(k_L)$ by the gain coefficient $B(k_L)$ is calculated so as to find a composite restoration waveform y'(n) via M-point inverse FFT (inverse fast Fourier transform) of the spectrum Y'(k).

On the other hand, if the gain coefficient $B(k_L)$ is decided not to be negative, the spectrum $Y'(k) \equiv (B(k_L))^{1/2}Y(k_L)$ that multiplies the main frequency component $Y(k_L)$ by the gain coefficient $B(k_L)$ is calculated so as to find the composite restoration waveform y'(n) via M-point inverse FFT (inverse fast Fourier transform) of the spectrum Y'(k) in the step SP31.

Next, in step SP32, after obtaining an analytic signal x'(n) by truncating the composite restoration waveform y'(n) at point "N", a restoration signal (frame sound signal) s'(n) is obtained via adoption of a real part (Re[x'(n)]) of the analytic signal x'(n).

Next, in step SP 33, after fixing the wave-form by carrying out processing such as overlap add processing, etc. with respect to the restoration signal s'(n), the processed restoration signal s'(n) is outputted as a sound signal from the earphone 24. Then, the sound signal outputted from the earphone 24 is such sound signal as the acoustic nerve excitation pattern is the same as the normal hearing individual, so that it is heard by the wearer (the hearing impaired individual) of the hearing aid device as such sound signal as the normal hearing individual feels.

FIG. 7 shows acoustic nerve excitation patterns "a", "b", "c" calculated by using the second embodiment of the present invention. "a" (solid line) is the acoustic nerve excitation pattern of the normal hearing individual calculated via the acoustic filter. "b" (one-dot chain line) and "c" (broken line) each represent the case that the frequency axis convolution operation is processed with respect to the acoustic filter $G_L(k)$ of the hearing impaired individual after multiplying the main sine-wave peaks $P_L(k_L)$ by the gain coefficient $B(k_L)$. "b" is the acoustic nerve excitation pattern that the hearing impaired individual may have in the case where the gain coefficient $B(k_L)$ is negative but not phase-inverted, while "c" is the acoustic nerve excitation pattern that the hearing impaired individual may have in the case where the gain coefficient $B(k_L)$ is negative and phase-inverted.

Such gain coefficient $B(k_L)$ as these acoustic nerve excitation patterns of the hearing impaired individuals are identical with the acoustic nerve excitation pattern "a" of the normal hearing individual is calculated in the step SP28. When the gain coefficient $B(k_L)$ is positive, the composite restoration waveform y'(n) is found in the step SP31. Also, when the gain coefficient $B(k_L)$ is negative, the phase is inverted in the step SP30 and thereafter the composite restoration waveform y'(n) is found in the step SP31.

As shown in FIG. 8, a hearing aid device 41 in relation to the third embodiment of the present invention comprises a microphone 42, a hearing aid processor 43 and an earphone 44. The microphone 42 converts a sound signal into an electric signal so as to output the converted electric signal. The hearing aid processor 43 performs various kinds of signal processing with respect to the output electric signal of the microphone 42 so as to output the signal processed electric signal. The earphone 44 converts the output signal of the hearing aid processor 43 into an acoustic signal so as to output the same as a sound signal.

The hearing aid processor 43 comprises a signal processing element 45, band-pass filters 46•1~46•N, acoustic nerve excitation pattern calculation elements 47•1~47•N, 48∩1~48•N, acoustic filter shape memory elements 49•1~49•N, 50•1~50•N, correction coefficient calculation elements 51•1~51•N, a correction coefficient multiplication element 52, a restoration processing element 53, etc.

Herein, data of acoustic filter shapes of normal hearing individuals are stored previously in the acoustic filter shape memory elements 49•1~49•N while data of acoustic filter shapes of wearers (hearing impaired individuals) of a hearing aid device are measured previously and stored in the acoustic filter shape memory elements 50•1~50•N.

The signal processing element 45 calculates a power spectrum by carrying out the fast Fourier transform (FFT) with respect to the output electric signal of the microphone 42 and outputs the same to the acoustic nerve excitation pattern calculation elements 46•1~46•N and to the correction coefficient multiplication element 52. The signal processing element 45 also carries out peak picking, extracts a specific frequency component from the calculated power spectrum, and performs various kinds of signal processing.

The band-pass filters 46•1~46•N divide not only the power spectrum calculated by the signal processing element 45 into bands of not less than N (N≧2) but also the specific frequency component of the power spectrum extracted by the signal processing element 45 into bands of not less than N (N≧2).

The acoustic nerve excitation pattern calculation elements 47•1~47•N calculate acoustic nerve excitation patterns of the normal hearing individuals from each of frequency components of the bands divided by the band-pass filters 46•1~46•N and from the acoustic filter shapes of the normal hearing individuals stored in the acoustic filter shape memory elements 49•1~49•N. On the other hand, another acoustic nerve excitation pattern calculation elements 48•1~48•N calculate acoustic nerve excitation patterns of the hearing impaired individuals from each of frequency components of the bands divided by the band-pass filters 46•1~46•N and from the acoustic filter shapes of the hearing impaired individuals stored in the acoustic filter shape memory elements 50•1~50•N.

The correction coefficient calculation elements 51•1~51•N compare the acoustic nerve excitation patterns of the normal hearing individuals that the acoustic nerve excitation pattern calculation elements 47•1~47•N calculate and the acoustic nerve excitation patterns of the hearing impaired individuals that the acoustic nerve excitation pattern calculation elements 48•1~48•N calculate, so as to calculate such correction coefficients (gain coefficients) with respect to each of frequency components of the divided power spectrum bands that the acoustic nerve excitation patterns of the hearing impaired individuals are identical with the acoustic nerve excitation patterns of the normal hearing individuals. The calculated correction coefficients (gain coefficients) are inputted to the correction coefficient multiplication element 52.

The correction coefficient multiplication element 52 multiplies each of frequency component of the power spectrum outputted from the signal processing element 45 by the absolute values of the gain coefficients corresponding to each of frequency components calculated by the correction coefficient calculation elements 51•1~51•N so as to be inputted to the restoration processing element 53. The restoration processing element 53 obtains a restoration signal by carrying out inverse FFT (inverse fast Fourier transform), etc. with respect to the power spectrum multiplied by the absolute values of the gain coefficients, so as to input the same to the earphone 44.

Next, the hearing aid processing method and an operation of the hearing aid device 41 employing the method in accordance with the present invention will be explained hereunder with reference to the flow chart as shown in FIG. 9.

Firstly, in step SP41, a sound signal is inputted via the microphone 42 and a frame sound signal s(n) is prepared by cutting and picking up a certain period of sound data at point "N". In step SP42, the sound signal s(n) is zero-filled at point "M" so as to prepare an M-point analysis signal y(n). An analysis signal x(n) is prepared based on the M-point analysis signal y(n).

Next, in step SP43, Y(k) is obtained via FFT (fast Fourier transform) from the M-point analysis signal x(n). In step SP44, a power spectrum P(k) of point M/2 is calculated.

Next, in step SP45, by carrying out peak picking, "D" pieces of main sine-wave peaks $P_L(k_L) \equiv |Y(k)|^2|_{K=KL} = |Y(k_L)|^2$ (L=1, . . . D) are extracted from the power spectrum P(k). For example, given D=10, 10 pieces of the main sine-wave peaks $P_L(k_L)$ are extracted.

Then, in step SP46, there is given "i"=1 in order to carry out operation processing for every 2 (two) pieces from low frequency with respect to 10 (ten) pieces of the main sine-wave peaks $P_L(k_L)$. Two pieces of the main sine-wave peaks $P_i(k_i)$ and the main sine-wave peaks $P_{i+1}(k_{i+1})$ are operation-processed without being influenced by another main sine-wave peaks $P_L(k_L)$.

Next, in step SP47, the acoustic nerve excitation pattern E(k) of the normal hearing individual is obtained from two pieces of the main sine-wave peaks $P_i(k_i)$ and the main sine-wave peaks $P_{i+1}(k_{i+1})$. Namely, the acoustic nerve excitation pattern E(k) of the normal hearing individual is found via frequency axis convolution operation of the power spectrum P(k) indicated by the following formula (5). Herein, $H_L(k)$ represents the acoustic filter of the normal hearing individual.

$$E(k) \equiv \sum P_L(k_L) * H_L(k) \tag{5}$$

Then, in step SP48, the acoustic nerve excitation pattern F(k) of the hearing impaired individual is obtained from two pieces of the main sine-wave peaks $P_i(k_i)$ and the main sine-wave peaks $P_{i+1}(k_{i+1})$. Namely, the acoustic nerve excitation pattern F(k) of the hearing impaired individual is found via frequency axis convolution operation of the power spectrum P(k) indicated by the following formula (6). Herein, $G_L(k)$ represents the acoustic filter of the hearing impaired individual.

$$F(k) \equiv \sum P_L(k_L) * G_L(k) \tag{6}$$

Next, in step SP49, a couple of gain coefficient $B(k_i)$ and gain coefficient $B(k_{i+1})$ are found such that the acoustic nerve excitation pattern, which is obtained by processing the frequency axis convolution operation with respect to the acoustic filter $G_L(k)$ of the hearing impaired individual after multiplying the main sine-wave peaks $P_L(k_L)$ by the couple of gain coefficient $B(k_i)$ and gain coefficient $B(k_{i+1})$, is equal to the acoustic nerve excitation pattern E(k) of the normal hearing individual. Namely, there are calculated such couple of gain coefficient $B(k_i)$ and gain coefficient $B(k_{i+1})$ as to be $$E(k) \equiv \sum B(k_L)P_L(k_L) * G_L(k).$$

Herein, the couple of gain coefficient $B(k_i)$ and gain coefficient $B(k_{i+1})$ with respect to two pieces of the main sine-wave peak $P_i(k_i)$ and the main sine-wave peaks $P_{i+1}(k_{i+1})$ are found as the least square error solution with respect to $E(k) \equiv \Sigma B(k_L)P_L(k_L)*G_L(k)$.

Next, in step SP50, there is decided whether or not i+1=D is satisfied in order to decide whether the gain coefficients $B(k_L)$ are calculated with respect to all of "D" pieces of main sine-wave peaks $P_L(k_L)$ extracted from the power spectrum P(k). If the decision not to meet i+1=D is made, there is given i=i+2 in step SP51 and the gain coefficients $B(k_L)$ are calculated with respect to all of "D" pieces of the main sine-wave peaks $P_L(k_L)$ via the step SP47, the step SP48 and the step SP49.

In this embodiment of the present invention, while each of the gain coefficient $B(k_L)$ is calculated via operation processing for every 2 (two) pieces from low frequency with respect to "D" pieces of the main sine-wave peaks $P_L(k\ L)$, the operation processing may be performed for one piece each or every three pieces and there is no limit in number thereof.

Meanwhile, when the gain coefficient is decided to meet i+1=D, in step SP52, a spectrum $Y'(k) \equiv (B(k_L))^{1/2}Y(k_L)$ that multiplies the main frequency component $Y(k_L)$ by the gain coefficient $B(k_L)$ is calculated so as to find a composite restoration waveform y'(n) via M-point inverse FFT (inverse fast Fourier transform) of the spectrum Y'(k).

Next, in step SP53, after obtaining an analytic signal x'(n) by truncating the composite restoration waveform y'(n) at point "N", a restoration signal (frame sound signal) s'(n) is obtained via adoption of a real part (Re[x'(n)]) of the analytic signal x'(n).

Next, in step SP54, after fixing the wave-form by carrying out processing such as overlap add processing, etc. with respect to the restoration signal s'(n), the processed restoration signal s'(n) is outputted as a sound signal from the earphone 44. Then, the sound signal outputted from the earphone 44 is such sound signal that the acoustic nerve excitation pattern is the same as the normal hearing individual, so that it may be heard by the wearer (the hearing impaired individual) of the hearing aid device as the same sound signal as the normal hearing individual feels.

FIG. 10 shows acoustic nerve excitation patterns calculated by using the second embodiment of the present invention. FIG. 10(*a*) shows the acoustic nerve excitation patterns in one of divided bands, wherein "a" (solid line) represents the acoustic nerve excitation pattern of the normal hearing individual calculated via the acoustic filter, and "b" (broken line) represents the acoustic nerve excitation pattern, calculated by using the acoustic filter, that the hearing impaired individual is expected to have.

FIG. 10(*b*) shows acoustic nerve excitation patterns after putting the divided bands together. "a" (solid line) represents the acoustic nerve excitation pattern of the normal hearing individual calculated via the acoustic filter. "b" (one-dot chain line) and "c" (broken line) each represent the case that the frequency axis convolution operation is processed with respect to the acoustic filter $G_L(k)$ of the hearing impaired individual after multiplying the main sine-wave peaks $P_L(k_L)$ by the gain coefficient $B(k_L)$, wherein "b" is the acoustic nerve excitation pattern that the hearing impaired individual is expected to have, in the case of multiplying the gain coefficient $B(k_L)$ found by dividing the band, while "c" is the acoustic nerve excitation pattern that the hearing impaired individual is expected to have, in the case of multiplying the gain coefficient $B(k_L)$ found without dividing the band.

In the above-described embodiments of the present invention, while the acoustic nerve excitation pattern is calculated using the acoustic filter shape, the acoustic nerve pattern can be also calculated using the width of the critical threshold band or the masking pattern in lieu of the acoustic filter shape.

Further, when measuring the acoustic filter shape, the critical threshold band width or the masking pattern with the measuring equipment, it is required to remove the hearing aid device, because the inspection sound for finding the acoustic filter shape, the critical threshold band width or the masking pattern is generated from the measuring equipment. However, it is possible to generate the inspection sound from the hearing aid device in order for measuring the acoustic filter shape, the critical threshold band width or the masking pattern without removal of the hearing aid device in the case of measurement.

INDUSTRIAL APPLICABILITY

Now that the hearing aid device according to the present invention performs such correction processing with respect to the input sound signal to obtain the output sound signal as the acoustic nerve excitation pattern of the hearing impaired individual becomes identical with the acoustic nerve excitation pattern of the normal hearing individual, the degradation of the frequency selective is so compensated that the wearer of the hearing aid device can hear an environmental sound with such good sense or feeling as the normal hearing individual feels, thereby being assured of the comfortable wearing. Thus, the present invention may contribute to the spread of the hearing aid device.

Although there have been described what are the present exemplary embodiments of the invention, it will be understood that variations and modifications may be made thereto within the spirit and scope of the appended claims.

What is claimed is:

1. A hearing aid processing method for a hearing aid processing a sound signal inputted via a microphone so as to output a sound signal from an earphone, comprising the step of:

obtaining an output sound signal by processing correction to an input sound signal such that an acoustic nerve excitation pattern of a hearing impaired individual is identical with an acoustic nerve excitation pattern of a normal hearing individual, wherein said processing correction involves comparing the acoustic nerve excitation pattern of the hearing impaired individual to an acoustic nerve excitation pattern of a normal hearing individual, calculating a gain coefficient based on the comparison result such that the acoustic nerve excitation pattern of the hearing impaired individual will become identical with an acoustic nerve excitation pattern of the normal hearing individual, and modifying the inputted sound signal using the gain coefficient.

2. A hearing aid processing method for a hearing aid processing a sound signal inputted via a microphone so as to output a sound signal from an earphone, comprising the steps of:

calculating an acoustic nerve excitation pattern of a hearing impaired individual; and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein when the correction coefficient is negative, a phase of the frequency component of the power spectrum is inverted, and the phase-inverted frequency component of the power spectrum is multiplied by an absolute value of the correction coefficient.

3. A hearing aid processing method for a hearing aid processing a sound signal inputted via a microphone so as to output a sound signal from an earphone, comprising the steps of:

calculating an acoustic nerve excitation pattern of a hearing impaired individual; and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein the power spectrum is divided into two or more bands, and the correction coefficient is calculated with respect to each of frequency components of the respective bands.

4. A hearing-aid processing method for a hearing aid processing a sound signal inputted via a microphone so as to output a sound signal from an earphone, comprising the steps of:

calculating an acoustic nerve excitation pattern of a hearing impaired individual; and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein a specific frequency component is extracted from the power spectrum and divided into two or more bands, and the correction coefficient is calculated with respect to each of frequency components of the respective bands.

5. A hearing aid processing method according to claim 1, wherein each of the acoustic nerve excitation patterns of the normal hearing individual and hearing impaired individual is calculated using the input sound signal and masking patterns of the normal hearing individual and the hearing impaired individual which have been stored in memory.

6. A hearing aid processing method according to claim 1, wherein each of the acoustic nerve excitation patterns of the normal hearing individual and hearing impaired individual is calculated using the input sound signal and each of acoustic filter shapes of the normal hearing individual and the hearing impaired individual which have been stored in memory.

7. A hearing aid processing method according to claim 1, wherein each of the acoustic nerve excitation patterns of the normal hearing individual and hearing impaired individual is calculated using the input sound signal and each of widths of critical threshold bands of the normal hearing individual and the hearing impaired individual which have been stored in memory.

8. A hearing aid processing method according to claim 1, wherein each of the acoustic nerve excitation patterns of the normal hearing individual and hearing impaired individual is calculated using a specific frequency component of the input sound signal.

9. A hearing aid device for a hearing aid processing a sound signal inputted via a microphone so as to output a sound signal from an earphone, comprising a hearing aid processor provided to obtain an output sound signal by processing correction to an input sound signal such that an acoustic nerve excitation pattern of a hearing impaired individual is identical with an acoustic nerve excitation pattern of a normal hearing individual, wherein the processor: compares the acoustic nerve excitation pattern of the hearing impaired individual to the acoustic nerve excitation pattern of the normal hearing individual; calculates a gain coefficient based on the comparison result such that the acoustic nerve excitation pattern of the hearing impaired individual will become identical with the acoustic nerve excitation pattern of the normal hearing individual; and modifies the inputted sound signal using the gain coefficient.

10. A hearing aid device according to claim 9, wherein the hearing aid processor comprises a signal processing element for carrying out various processing with respect to an output signal of a microphone, an acoustic nerve excitation pattern calculation element for calculating each of the acoustic nerve excitation patterns of the normal hearing individual and the hearing impaired individual from an output signal of the signal processing element and each of acoustic filter shapes of the normal hearing individual and the hearing impaired individual, an acoustic filter shape memory element for storing the acoustic filter shapes of the normal hearing individual and the hearing impaired individual, a comparison element for calculating said gain coefficient such that the acoustic nerve excitation pattern of the hearing impaired individual is identical with the acoustic nerve excitation pattern of the normal hearing individual, and a correction processing element for correcting the output signal of the signal processing element via the gain coefficient calculated by the comparison element.

11. A hearing aid device according to claim 9, wherein the hearing aid processor comprises a signal processing element for carrying out various processing with respect to an output signal of a microphone, an acoustic nerve excitation pattern calculation element for calculating each of the acoustic nerve excitation patterns of the normal hearing individual and the hearing impaired individual from an output signal of the signal processing element and each of widths of critical threshold bands of the normal hearing individual and the hearing impaired individual, a critical threshold band width memory element for storing the widths of the critical threshold bands of the normal hearing individual and the hearing impaired individual, a comparison element for calculating said gain coefficient such that the acoustic nerve excitation pattern of the hearing impaired individual is identical with the acoustic nerve excitation pattern of the normal hearing individual, and a correction processing element for correcting the output signal of the signal processing element via the gain coefficient calculated by the comparison element.

12. A hearing aid device according to claim 9, wherein the hearing aid processor comprises a signal processing element for carrying out various processing with respect to an output signal of a microphone, an acoustic nerve excitation pattern calculation element for calculating each of the acoustic nerve excitation patterns of the normal hearing individual and the hearing impaired individual from an output signal of the signal processing element and each of masking patterns of the normal hearing individual and the hearing impaired individual, a masking pattern memory element for storing the masking patterns of the normal hearing individual and the hearing impaired individual, a comparison element for calculating said gain coefficient such that the acoustic nerve excitation pattern of the hearing impaired individual is identical with the acoustic nerve excitation pattern of the normal hearing individual, and a correction processing element for correcting the output signal of the signal processing element via the gain coefficient calculated by the comparison element.

13. A hearing aid device which processes a sound signal inputted via a microphone so as to output a sound signal from an earphone, comprising a hearing aid processor which calculates an acoustic nerve excitation pattern of a hearing impaired individual and obtains an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein when the correction coefficient is negative, a phase of the frequency component of the power spectrum is inverted, and the phase-inverted frequency component of the power spectrum is multiplied by an absolute value of the correction coefficient.

14. A hearing aid device which processes a sound signal inputted via a microphone so as to output a sound signal from an earphone, comprising a hearing aid processor for calculating an acoustic nerve excitation pattern of a hearing impaired individual and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein the power spectrum is divided into two or more bands, and the correction coefficient is calculated with respect to each of frequency components of the respective bands.

15. A hearing aid device which processes a sound signal inputted via a microphone so as to output a sound signal from an earphone, comprising a hearing aid processor for calculating an acoustic nerve excitation pattern of a hearing impaired individual and obtaining an output sound signal by multiplying each of frequency components of a power spectrum of an input sound signal by a correction coefficient such that the acoustic nerve excitation pattern of the hearing impaired individual is identical with an acoustic nerve excitation pattern of a normal hearing individual, wherein a specific frequency component is extracted from the power spectrum and divided into two or more bands, and the correction coefficient is calculated with respect to each of frequency components of the respective bands.

16. A hearing aid device according to claim 9, wherein the acoustic nerve excitation pattern of the hearing impaired individual is calculated using a specific frequency component of the input sound signal.

17. A hearing aid device according to claim 13, wherein the acoustic nerve excitation pattern is calculated using the input sound signal and an acoustic filter shape.

18. A hearing aid device according to claim 13, wherein the acoustic nerve excitation pattern is calculated using the input sound signal and a width of a critical threshold band.

19. A hearing aid device according to claim 10, wherein the hearing aid device outputs an inspection sound for finding the acoustic filter shapes of the normal hearing individual and the hearing impaired individual.

20. A hearing aid device according to claim 17, wherein the hearing aid device outputs an inspection sound for finding the acoustic filter shape.

* * * * *